US006405830B1

(12) United States Patent
Hayman

(10) Patent No.: US 6,405,830 B1
(45) Date of Patent: Jun. 18, 2002

(54) SCAFFOLD TOEBOARD SYSTEM

(75) Inventor: Yates Westley Hayman, Walker, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 0 days.

(21) Appl. No.: 09/606,368

(22) Filed: Jun. 28, 2000

(51) Int. Cl.[7] ..... A47L 3/02

(52) U.S. Cl. ..... 182/113; 182/178.1; 182/178.6; 182/186.7; 52/637

(58) Field of Search ..... 182/113, 178.1, 182/178.2, 178.3, 178.4, 178.5, 178.6, 179.1, 222, 186.7, 186.8; 256/59, 65; 52/637, 638; 403/305, 306, 348, 373, 378, 409

(56) References Cited

U.S. PATENT DOCUMENTS 3,844,520 A * 10/1974 Werner et al. ..... 248/228
3,853,203 A * 12/1974 Werner et al. ..... 182/113
4,111,579 A * 9/1978 Knight ..... 403/387
4,219,175 A * 8/1980 Harig ..... 248/125
4,597,472 A * 7/1986 Hjelm ..... 182/178.6
5,285,869 A * 2/1994 Rock ..... 182/178
5,400,870 A * 3/1995 Inoue ..... 182/178
5,462,134 A * 10/1995 Van Helmond ..... 182/178
5,842,685 A * 12/1998 Purvis et al. ..... 256/67
5,913,508 A * 6/1999 Eades ..... 256/65
6,000,175 A * 12/1999 Gale et al. ..... 52/63
6,279,880 B1 * 8/2001 Hawk, Jr. ..... 256/67

* cited by examiner

*Primary Examiner*—Bruce A. Lev
(74) *Attorney, Agent, or Firm*—Jones, Walker, Waechter, Poitevent, Carrere & Denegre, L.L.P.

(57) ABSTRACT

A scaffold toeboard system for use on a scaffold where the system includes a bracket attachable to a horizontal scaffold frame member, a first sleeve attached to the bracket, where the sleeve has at least one slot, and a toeboard having two ends, with each end having a clip section which is insertable into the sleeve slot, and a lock, where the lock is a second sleeve slidable with respect to the first sleeve and which engages with the clip section to prevent removal of the toeboard.

17 Claims, 7 Drawing Sheets

SCAFFOLD TOEBOARD SYSTEM

BACKGROUND OF THE INVENTION

1. Technical Field

This invention relates to scaffolding, and in particular, to scaffold toeboard systems.

2. Background Art

Scaffold systems generally have a framework of horizontal members and vertical members, which create a structure for supporting an elevated platform work area. The platform generally consists of scaffold boards, constructed of either metal or wood. OSHA requires all scaffold systems have toe boards. Toeboards are boards that are attached to the scaffold system near the edges of the platform and function to keep materials from falling or rolling off the work platform. Toeboards can also be used to secure the platform to the scaffold frame.

The general practice is to use 2×4 or 2×6 lumber as toeboards. These wooden toeboards may be nailed to the platform or wired to the platform with tiewraps or bailing wire. As the work platform can vary in size, each platform requires toeboards to be cut to size on the job site, or that various standard sizes are kept in stock.

Much scaffolding is exposed to weather. Due to weathering, and the means of attaching, wooden toeboards may be used several times, and then have to be discarded.

OBJECTS OF THE INVENTION

It is an object of the invention to provide a scaffold toeboard system that adjusts to different platform sizes.

It is an object of the invention to provide a scaffold toeboard system, which is easily mounted on a scaffold frame.

It is an object of the invention to provide a scaffold toeboard system, which easily and securely locks a scaffold toeboard to the scaffold frame.

SUMMARY OF THE INVENTION

Accordingly a scaffold toeboard system for use on a scaffold is provided where the system has a bracket attachable to a vertical scaffold frame member, a first sleeve attached to the bracket, where the sleeve has at least one slot, and a toeboard having two ends, with each end having a clip section which is insertable into a sleeve slot, and a lock, where the lock engages with the clip section to prevent removal of the toeboard.

DETAILED DESCRIPTION OF THE INVENTION

Figure 1B:
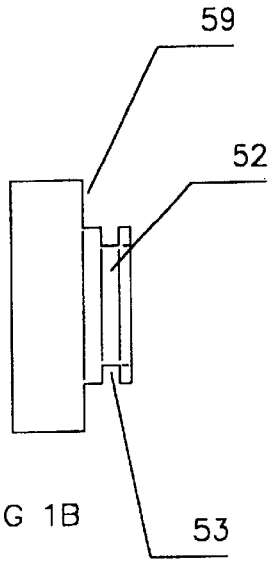
FIG. 1B shows a detailed view of the clip end of a toeboard.
Figure 1A:
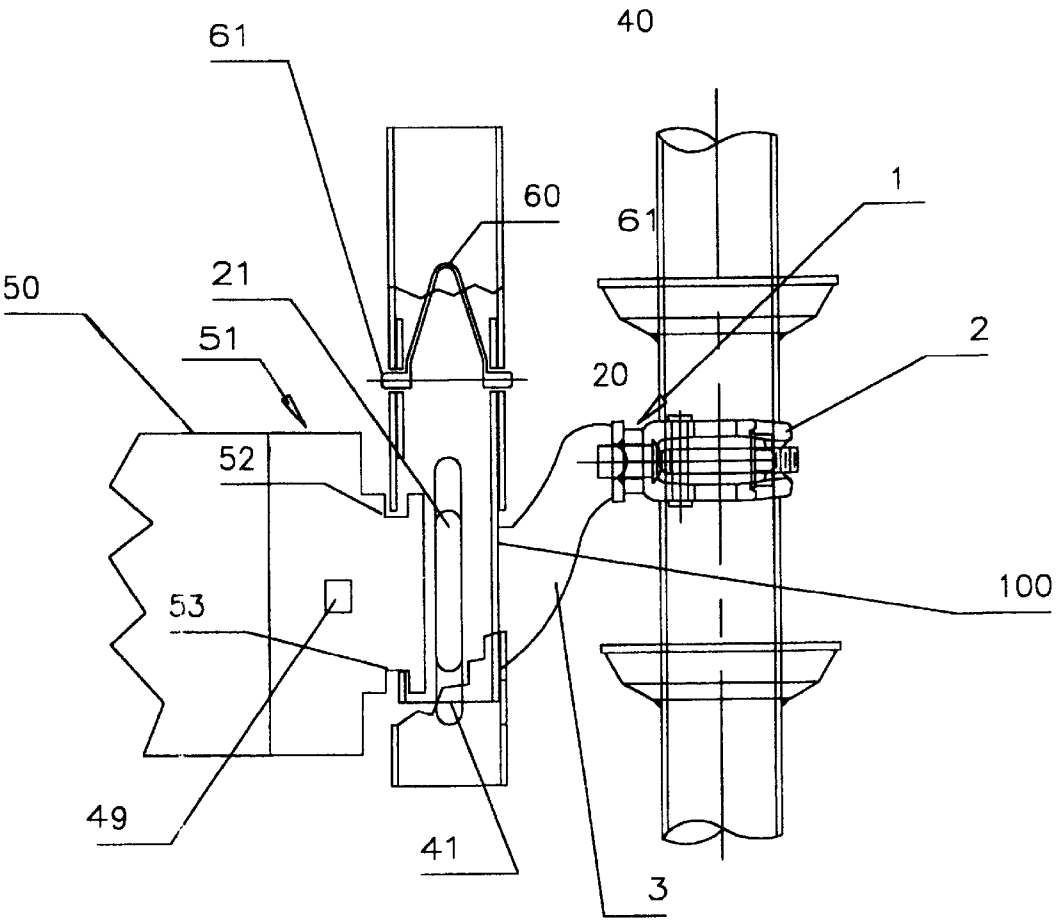
FIG. 1A depicts an isometric drawing of the scaffold bracket and a portion of the toeboard, and showing a partial cross section through the inner and outer sleeves.
Figure 6:
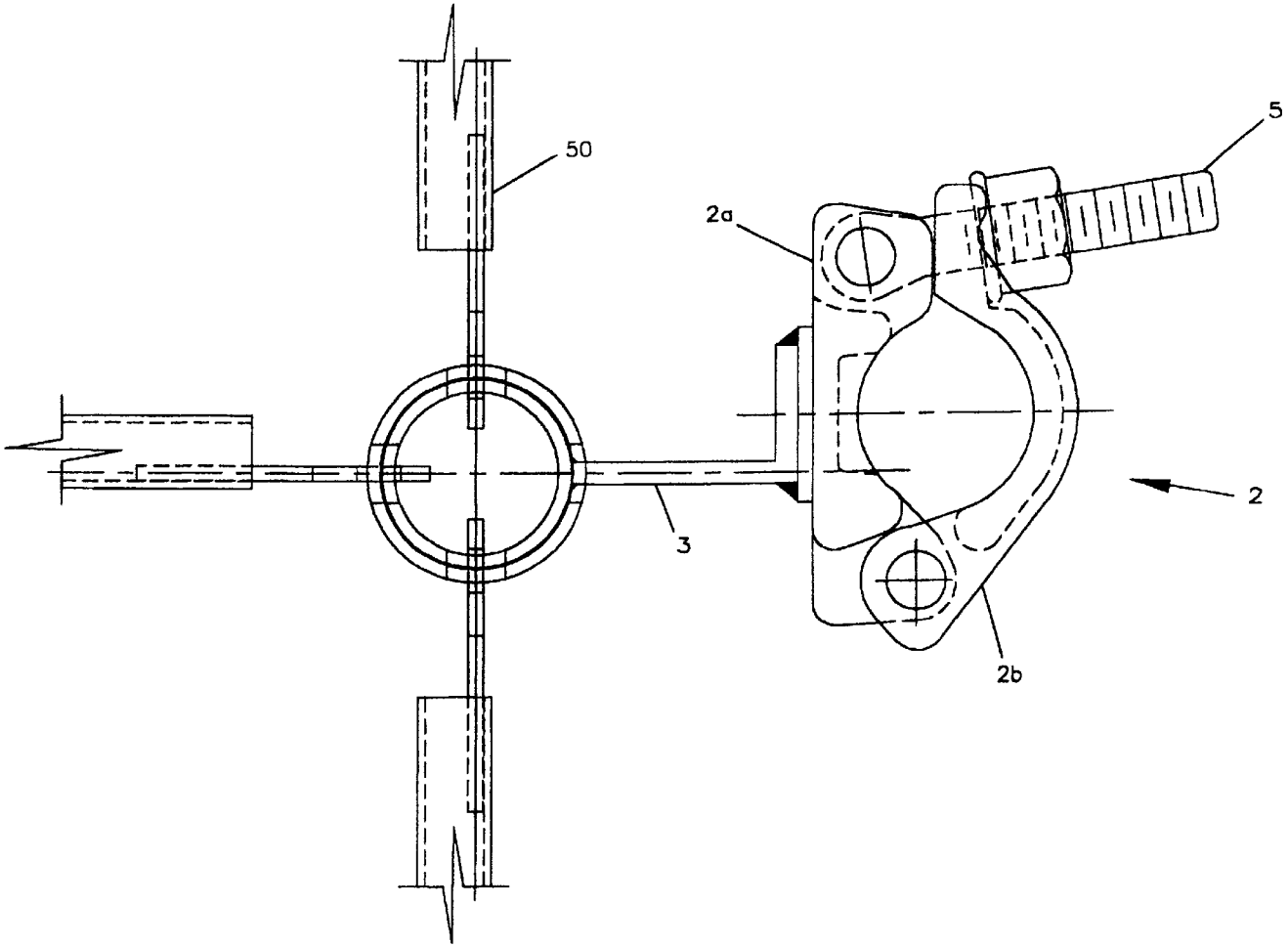
FIG. 6 is a top view of the clamp.

Shown in FIG. 1A is the bracket 1. Bracket 1 has a bracket clamp 2 and clamp mount 3. Clamp mount 3 is a plate which joins clamp 2 and inner sleeve 20 of the toeboard system. Bracket clamp 2 is shown attached to a scaffold vertical member. As is shown in FIG. 6, bracket clamp 2 has a first member 2*a* and a second member 2*b*. The second member 2*b* is hingedly attached to the first member 2*a,* to enable the clamp 2 to be easily installed on a scaffold vertical frame member. The two members are secured to each other through action of bolt 5. As shown, bolt 5 is hingedly connected to first member 2*a*.

As depicted in FIG. 1*a,* inner sleeve 20 is a cylinder attached to clamp mount 3, having a series of slots 21 cut through the sidewalls of the inner sleeve 20. As shown, inner sleeve 20 has three slots 21 placed in 90-degree increments about the point of attachment of the inner sleeve 20 to the clamp mount 3. Inner sleeve slots 21 are sized to accept the clip end 51 of toeboard 50, latter described.

Figure 2:
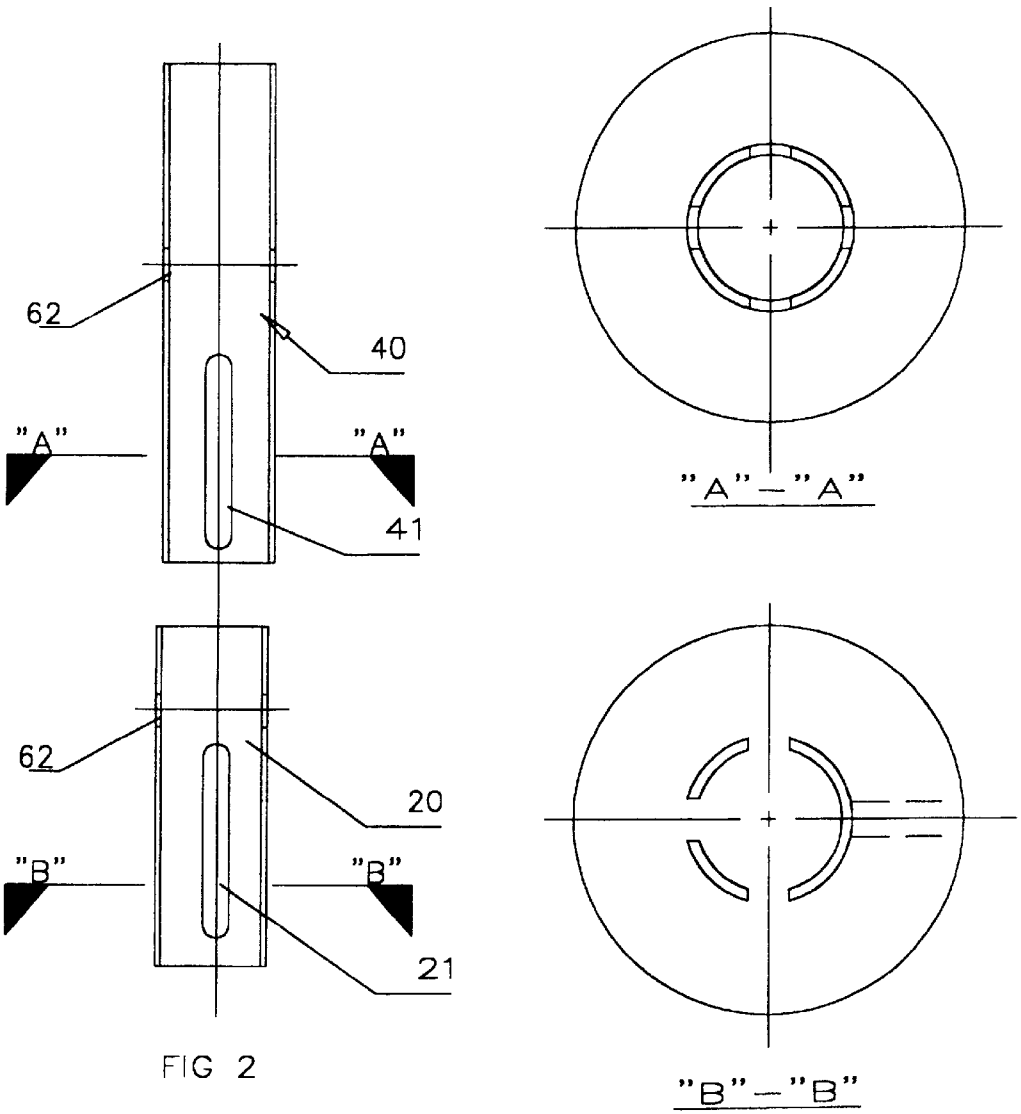
FIG. 2 shows an exploded view of the inner and outer sleeves.

Also shown is outer sleeve 40. Outer sleeve 40 is also a cylinder, sized to fit over and slidable about the inner sleeve 20. Outer sleeve 40 also has a series of outer sleeve slots 41, alignable with inner sleeve slots 21. The outer sleeve slots 41 and inner sleeve slots 21 thus cooperate to form a series of openings of variable size, with the size of the opening depending upon the relationship of the inner sleeve slots 21 with respect to the outer sleeve slots 41. The inner sleeve 20 and outer sleeve 40 are detailed in FIG. 2.

Outer sleeve 40 generally has 4 slots placed at 90 degree increments, with inner sleeve 20 having 3 slots placed at 90 degree increments. Consequently, one of the outer sleeve slots 41 will lack a matching inner sleeve slot 21. In assembling the bracket 1, outer sleeve 40 is slid over inner sleeve 20, and the clamp mount 3 is then butted up against inner sleeve 20 by inserting the clamp mount 3 through that outer sleeve slot 41 which has no matching opening in inner sleeve. The clamp bracket 3 is then welded to inner sleeve 20 at this location.

Also shown in FIG. 1A is toeboard 50. Toeboard 50 is a board member having two clip ends 51, one at each end of the toeboard 50. Each clip end 51 is sized to be insertable through one set of aligned inner and outer sleeve slots, 21 and 41. As detailed in FIG. 1B, clip end 51 has upper and lower notches, 52 and 53 respectively. In operation, the clip end 51 is inserted into the aligned inner and outer slots, 21 and 41, as shown in FIG. 1A. Toeboard 50 is then lowered until the lower notch 53 engages with the bottom of inner sleeve slot 21. The engagement of the lower notch 53 with bottom of inner sleeve notch 21 constrains the toeboard 50 from movement away from bracket 1. Toeboard 50, however, may still move upward with respect to bracket 1. To prevent upward movement of the toeboard 51, outer sleeve 40 is slid downwardly until the top of the outer sleeve slot 41 engages upper notch 52 of clip end 51. The clip end 51 of the toe board 50 is thus trapped or locked into the bracket 1 through the engagement of the inner and outer sleeves 20 and 40 with the upper and lower notches, 52 and 53, of clip ends 51.

To maintain the toeboard 50 in a locked position, it is necessary to fix the relative positions of the inner 20 and outer sleeve 40. Shown in FIG. 1*a* is a simple mechanism to accomplish this task, a spring loaded snap button 60. One end 61 of snap button 60 is fixed to the inner sleeve 2, while the other end has a button 62 which is sized to protrude through button openings 65 in both the inner 20 and outer sleeve 40. Button openings 62 in the sleeves align when the sleeves are in the locked position.

Figure 3:
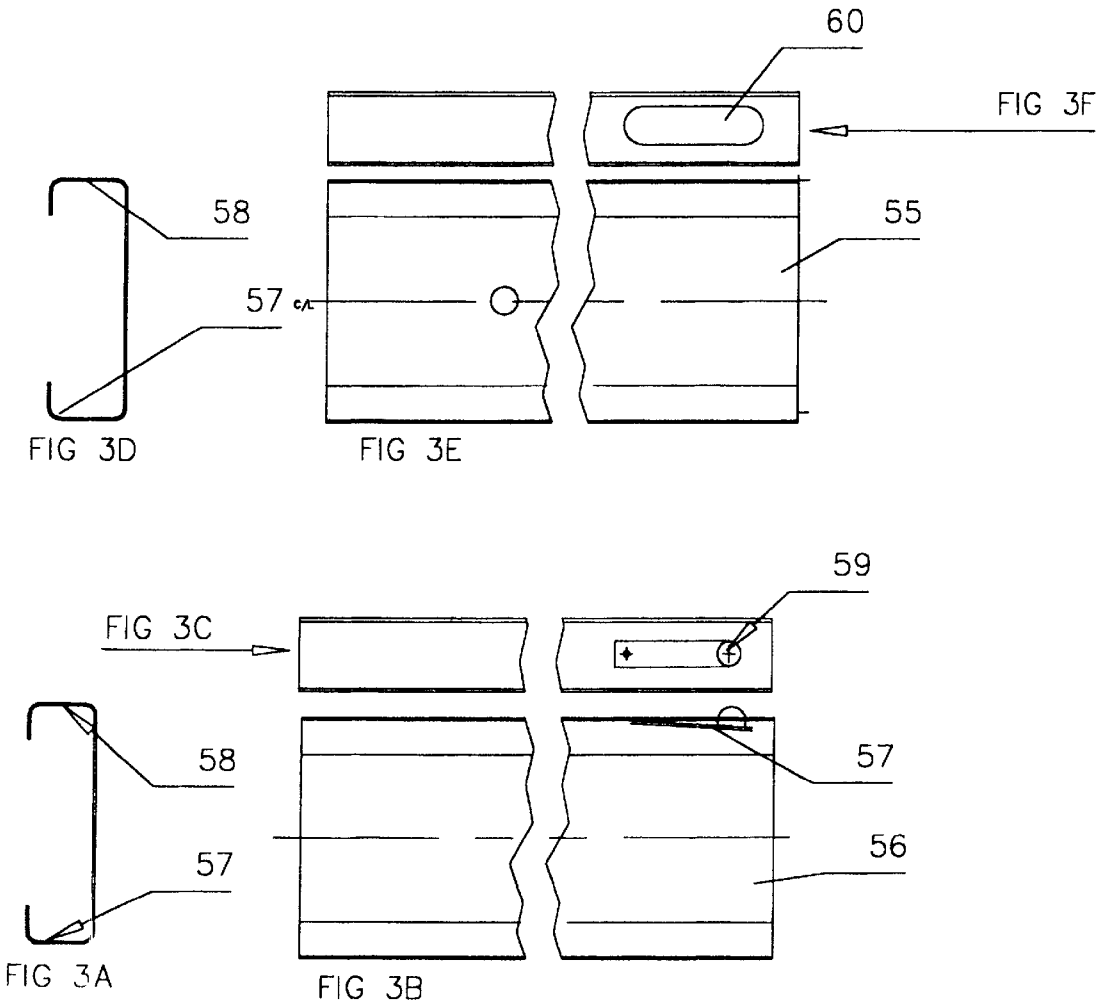
FIGS. 3*a,* 3*b* and 3*c* show a side view, cross-sectional view, and top view, respectively, of an inside toeboard.
FIGS. 3*d,* 3*e* and 3*f* show a side view, cross-sectional view, and top view, respectively, of an outside toeboard.

To provide flexibility to the system, toeboard 50 may be a telescoping board, thereby allowing the same board to accommodate different sized platforms. The telescoping toeboard has an inner board 56 (detailed in FIGS. 3*a,* 3*b* and 3*c*) and an outer board 55 (detailed in FIGS. 3*d,* 3*e* and 3*f*). Both inner and outer toeboards 55 and 56 are shown in cross section (FIGS. 3*a* and 3*f* respectively) as "C" shaped, having upper 58 and lower channels 57. The inner toeboard 55 is insertable into outer toeboard 56, and slidable with respect to outer toeboard 56. Upper and lower channels 57 and 58 on outer toeboard retains inner toeboard. The upper and lower channels 57 and 58 of inner toeboard, while not necessary, are provide to prevent a sharp edge from being exposed on the inner toeboard 56, for safety reasons.

Finally, a simple method is provided to keep inner 56 and outer toeboards 55 from disengaging. Shown is a snap button 57 positioned on the inner toeboard 56. Toeboard snap button 57 passes through opening 59 in top channel of inner toeboard (see FIG. 3*c*). When inner and outer toeboards 55 and 55 are fully extended, snap button 57 will also pass through slot 60 provided in upper channel 58 of outer toeboard 55. (see FIG. 3*f*). Engagement of toeboard snap button 57 with slot 60 in outer toeboard 55 will thus prevent further extension of the inner toeboard 56 with respect to the outer toeboard 55.

In construction, both toeboards are preferably made of galvanized 18-gauge steel. Additionally, it is preferred that clip ends 51 be of thicker steel to provide strength at the joint of the bracket 1 with toeboard 50.

In operation, a toeboard 50 is installed as follows: two brackets would be positioned and locked into place on vertical members of the scaffold frame through action of bracket clamps 2. Preferably, the brackets 1 are positioned so that when the toeboard 50 is installed, the installed toeboard 50 is placed adjacent to the scaffold platform deck. In this fashion, the installed toeboard 50 acts to retain the platform boards against the horizontal scaffold frame members. Once the brackets 1 are installed, one clip end 51 of toeboard 50 is inserted into the aligned slots 21 and 41 of the inner and outer sleeves, 20 and 40 of one bracket 1. The toeboard 50 is then lowered until lower notch 53 contacts and rests on the bottom of the inner sleeve slot 21. The outer sleeve 40 is then lowered until snap button 62 engages openings. In this fashion, upper end of outer sleeve slot 41 falls within upper notch 52 of clip end 51, and thus relative position of slots 41 and 21 act as a cage restraining the movement of the toeboard 50 with respect to bracket 1. Snap button 62 fixes the position of the sleeves and locks the toeboard 50 in place. After placing one end of toeboard, the other end of toeboard must similarly be fixed to a bracket 1. Toeboard 1 is telescoped until it is of suitable length for the remaining clip end to be locked into a second bracket by a similar process. Alternatively, both ends of toeboard could be locked into place simultaneously.

Because each bracket 1 has a series of slots on the sleeves, each bracket 1 can accommodate more than one toeboard 50. Obviously, all toeboards 50 which engage one bracket must be installed before the outer sleeve 40 is lowered and locked into place by snap button 62.

Other embodiments of the system are possible. For instance, the clamp mount 3 could be attached to the outer sleeve 40 instead of the inner sleeve 20. This is not preferred, however, because such an arrangement makes it difficult to control the movement of the inner sleeve 20 with respect to the outer sleeve 40. Outer and inner sleeves are shown as cylinders, but other shapes will also operated in similar fashions. Additionally, it is possible to dispense with the outer sleeve 40. Such is not preferred, however, as without the outer sleeve 40, the toeboard 50 may move upwardly in bracket 1.

Figure 4:
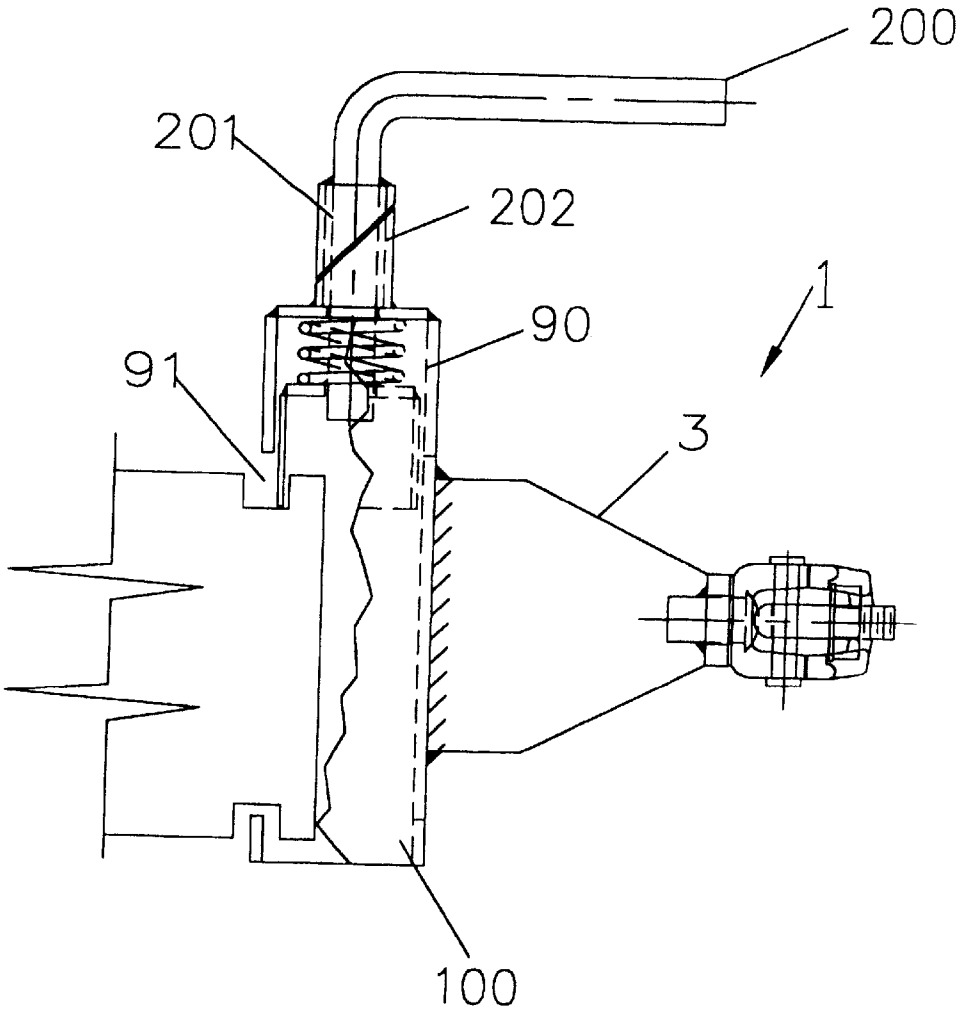
FIG. 4 shows an isometric view of another embodiment of the bracket, showing details of the locking mechanism.

An alternative embodiment is shown in FIG. 4. In this embodiment, clamp bracket 3 is attached to outer sleeve 90. Outer sleeve 90 is equipped with outer sleeve slots 91 as previously described. Inner sleeve 100 is slidable with respect to outer sleeve 90, and in this particular embodiment, inner sleeve 100 is rotatably slidable with respect to outer sleeve 90. Inner sleeve 100 is cylindrically shaped and attached to a spring-loaded rotatable handle 200. Inner sleeve 100 has no slots in this embodiment. However, when inner sleeve 100 is lowered by action of spring loaded handle, inner sleeve 100 cylinder side walls engage upper notch 52 on toeboard to retain toeboard in bracket 1, as is shown in FIG. 4. To assist action of handle 200, outer sleeve 90 has an end cap 201 with a slot 202 cut in the edge of the end cap. Slot 202 traverses partially around end cap 201 through a vertical extent, and has horizontal portions, or flats, at the top and bottom of the slot (not shown). Handle 200 has a projection, which engages the slot 202 (not shown), much like the threads of a bolt engage a nut. Slot and projection assist in moving inner sleeve 90 into locked position. At locked position, projection should be located in bottom flat to lock handle 200 in place.

Figure 5:
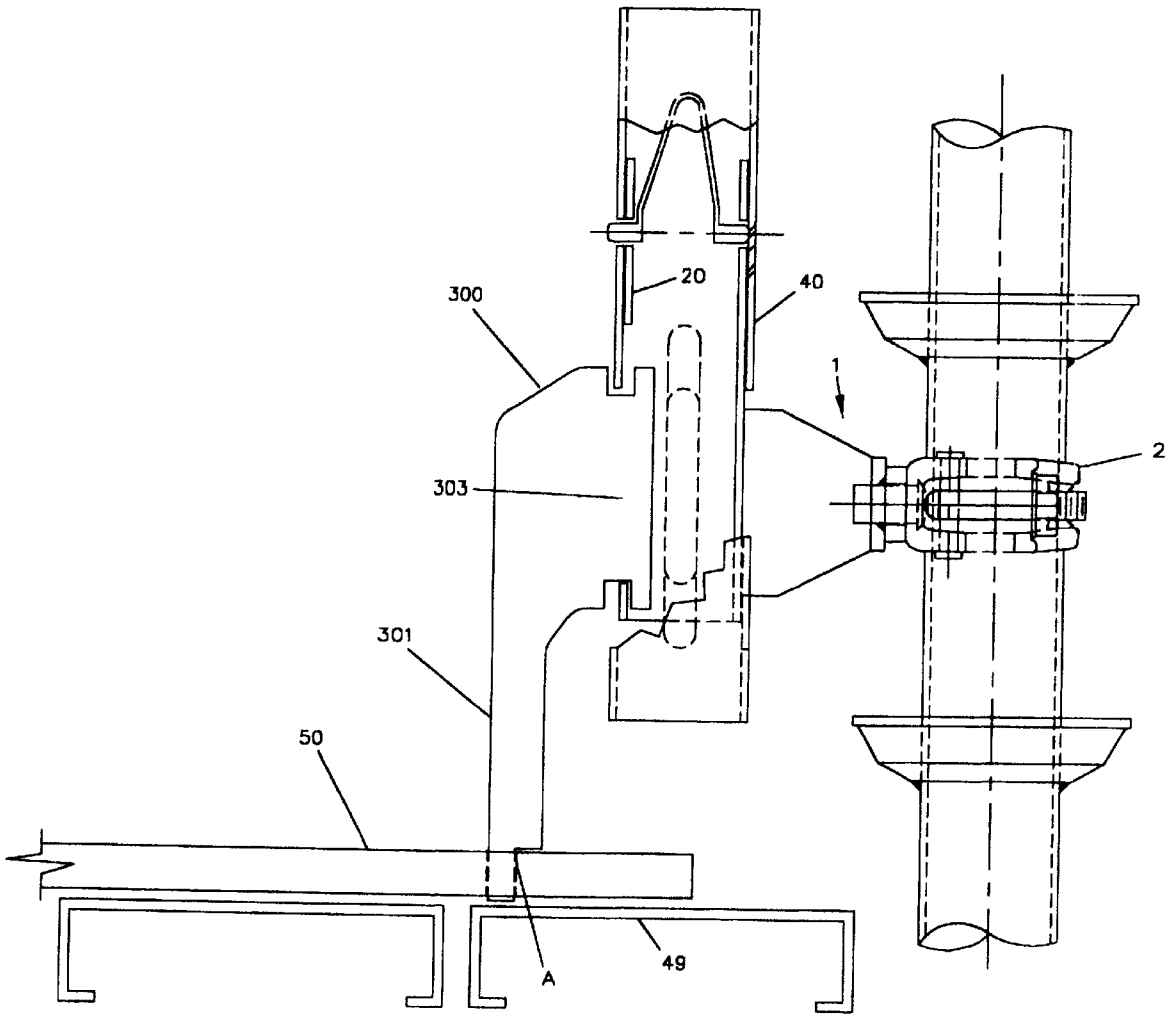
FIG. 5 is an isometric view of another embodiment of the invention.
Figure 7:
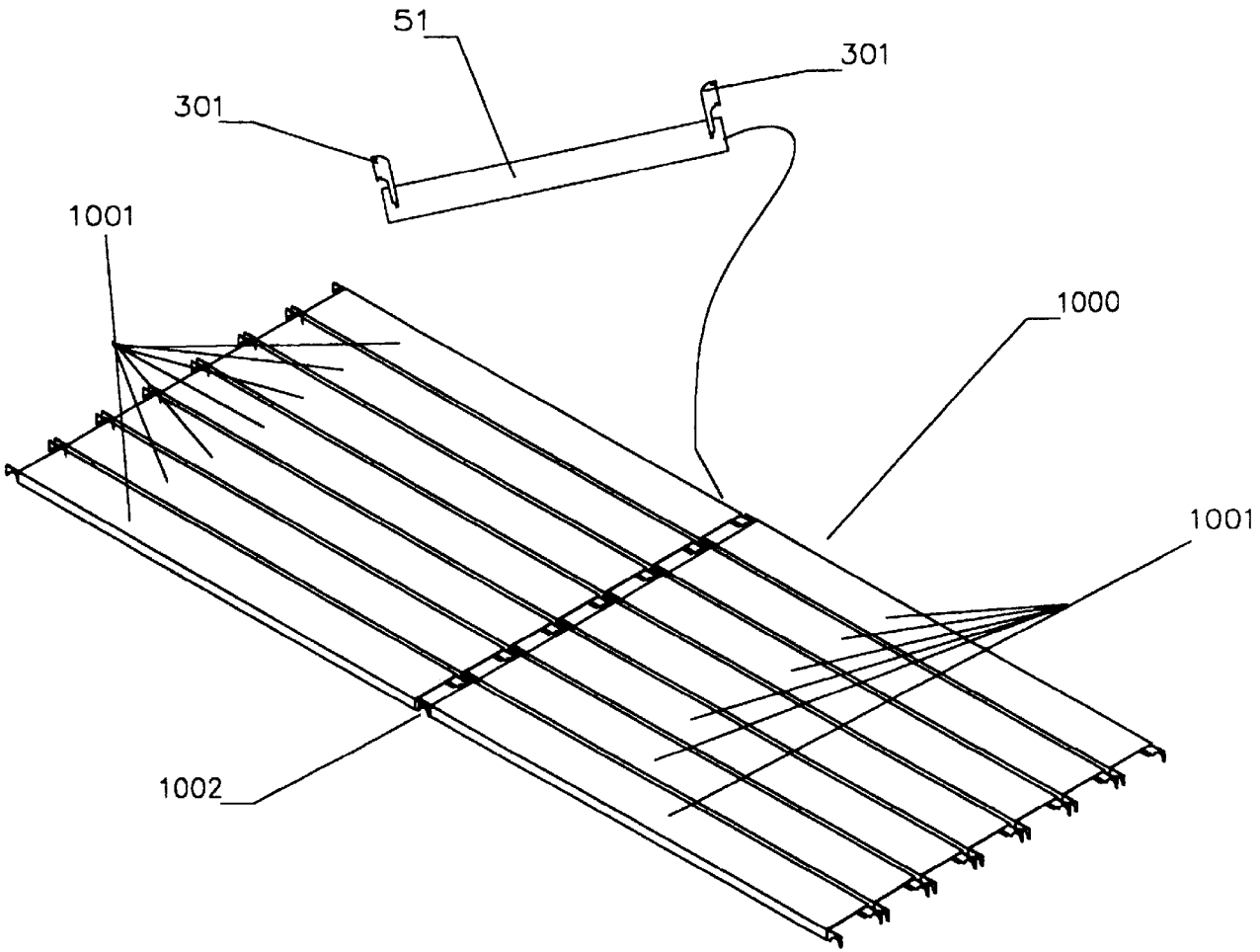
FIG. 7 shows an application of the embodiment invention shown in FIG. 5.

Another application of the toeboard system is as a platform hold-down, as shown in FIG. 5. As shown, the system includes the bracket 2 with inner 20 and outer sleeve 40, clamp 2 and toeboard 51. Additionally, the system includes a clip connector 300, constructed with a clip end 303 to engage the inner and outer sleeve slots 21 and 41. As shown, clip connector 300 is a downward projecting elbow 301, with clip end 303 being a finger projection. Clip connector is designed to engage a toeboard 50 when the toeboard is laying flat on the deck by having the clip end 303 of clip connector 300 pass through an opening 49 in the toeboard. Opening 49 is positioned near the clip end of the toeboard, and as shown, opening 49 passes through the vertical extent or section of the toeboard, as opposed to the horizontal section of the toeboard 50. This application can be of particular use when the platform is too long to be accommodated by single scaffold boards, but instead, requires at least two rows of boards placed end to end, as is shown in FIG. 7. As is shown in FIG. 7, a platform deck 1000 is constructed of a series of boards 1001. The deck is of such a length that some boards 1001 are laid end-to-end, creating a gap 1002 between these boards (shown as dotted). This gap presents an opening through which items can fall. By placing the telescoping toeboard 51 flat across this gap 1002, the gap can be covered, eliminating the danger. The flat toeboard 51 would: be attached to vertical scaffold frame members at opposite edges of the platform using the clip connector 303 and clamp 2, as shown in FIG. 5.

I claim:

1. A scaffold toeboard system for use on a scaffold, said scaffold having horizontal and vertical members, said toeboard system comprising (1) a bracket attachable to a vertical member (2) a first sleeve attached to said bracket, said sleeve having at least one first sleeve slot (3) a toeboard having first and second ends, said first and said second ends having a clip section, each of said clip sections being insertable into said at least one first sleeve slot (4) a lock, said lock engagable with said clip section of said toeboard to prevent removal of said toeboard when said lock is engaged with said clip section, where said lock comprises a second sleeve, said second sleeve movable with respect to said first sleeve.

2. A scaffold toeboard system according to claim 1 wherein said toeboard is a telescoping board.

3. A scaffold toeboard system according to claim 1 where each of said clip section comprises a lower notched portion, said lower notched portion engagable with said first sleeve slot to resist the withdrawal of said toeboard when said clip section is inserted in said first sleeve slot.

4. A scaffold toeboard system according to claim 1 wherein said second sleeve has at least one second sleeve slot alignable with said at least one first sleeve slot.

5. A scaffold toeboard system according to claim 1 where each of said clip section comprises an upper notch.

6. A scaffold toeboard system according to claim 5 wherein said second sleeve is engagable with said upper notch of said toeboard when said toeboard is inserted into said sleeve.

7. A scaffold toeboard system according to claim 1 wherein said clip section comprises an upper notch and a lower notch.

8. A scaffold toeboard system according to claim 1, wherein said system further has a retainer, said retainer fixing the position of said first sleeve with respect to said second sleeve.

9. A scaffold toeboard system according to claim 8 wherein said retainer comprises a button engagable with an opening.

10. A scaffold toeboard system according to claim 1 wherein said bracket comprises a first and second members, said first and second members being hingedly connected.

11. A scaffold toeboard system according to claim 1 having two slots, said two slots forming an angle therebetween of about 90 degrees.

12. A scaffold toeboard system according to claim 1 having three slots.

13. A scaffold toeboard system according to claim 1 further having an actuator for controlling the movement of said first sleeve with respect to said second sleeve.

14. A scaffold toeboard system according to claim 13 wherein said actuator comprises a handle attached to said second sleeve and a handle holder positioned on said first sleeve.

15. A scaffold toeboard system for use on a scaffold, said scaffold having horizontal and vertical members and a deck, said toeboard system comprising (1) a bracket removably attachable to a vertical member;

(2) a toeboard having a horizontal section and a vertical section, and at least one end and an opening positioned near said at least one end;

(3) said bracket further having a downwardly projecting clip connector, said clip connector having a having clip end adapted to engage said opening in said toeboard, a first sleeve attached to said bracket, said sleeve having at least one first sleeve slot and a second sleeve moveable with respect to said first sleeve, said second sleeve engagable with said clip connector to prevent removal of said clip connector when engaged with said clip connector.

16. A scaffold toeboard system according to claim 15 where said opening passes through said vertical section of said toeboard.

17. A scaffold toeboard system for use on a scaffold, said scaffold having horizontal and vertical members, said toeboard system comprising a bracket removably attachable to a vertical member; said bracket having a first sleeve attached to said bracket, said sleeve having at least one first sleeve slot; and a second sleeve moveable with respect to said first sleeve, said second sleeve engagable with and preventing removal of the clip section of a toeboard when engaged with said bracket.

* * * * *